US005168672A

United States Patent [19]

Grégoire, Sr.

[11] Patent Number: 5,168,672

[45] Date of Patent: Dec. 8, 1992

[54] SANDING BLOCK

[76] Inventor: Bernard Grégoire, Sr., 170 Champlain St., Berthierville, Quebec, Canada, J0K 1A0

[21] Appl. No.: 787,656

[22] Filed: Nov. 4, 1991

[51] Int. Cl.[5] ..... B24D 17/00

[52] U.S. Cl. ..... 51/380; 51/382; 51/383; 51/388; 51/392

[58] Field of Search ..... 51/380, 381, 382, 383, 51/385, 388, 390, 391, 392, 393, 370

[56] References Cited

U.S. PATENT DOCUMENTS 2,624,161 1/1953 Snell ..... 51/380

3,073,084 1/1963 Howard ..... 51/383

*Primary Examiner*—Bruce M. Kisliuk

*Assistant Examiner*—Eileen Morgan

[57] ABSTRACT

An abrasive paper sheet holder having a base provided with clamping shoulders formed in a pair of opposed side edges thereof. A handle member is detachably secured over a rear surface of the base. The handle member has opposed flexible flange walls for clamping opposed end edge portions of an abrasive paper sheet which is positioned over a front working surface of the base with the edge portions of the paper sheet extending over the clamping shoulders. The handle member applies a wedging pressure on the flexible flange walls to immovably clamp the opposed edge portions of the abrasive paper sheet between the end edges of the flexible flange walls and the clamping shoulders.

7 Claims, 2 Drawing Sheets

SANDING BLOCK

BACKGROUND OF INVENTION

1. Field of the Invention

The present invention relates to a hand-size abrasive paper sheet holder comprised of a base and a detachable handle member and wherein an abrasive paper sheet is held by clamping pressure between the handle member and the base.

2. Description of Prior Art

Various types of abrasive paper sheet holders are known as well as automatic sanding machines whereby an abrasive paper sheet is held over a flat working surface of a holder device. A disadvantage of many of these paper sheet holders is that the sheet often becomes detached during use due to various reasons but primarily due to the fact that the abrasive paper sheet is not rigidly clamped to the holder. Another disadvantage of the prior art is that some of the paper sheet holders are not capable of holding different coarseness of abrasive paper sheets or else do not have sufficient clamping pressure to retain the sheet and the sheet becomes disconnected from the sanding device, particularly when rubbed over a very rough surface. A still further disadvantage of the prior art is that some of these abrasive paper sheet holders require a tool, such as a screwdriver, in order to secure and remove the abrasive paper sheet from the holder. Some of these holders are also very expensive to construct. Sanding blocks are also known and about which an abrasive paper sheet is positioned and retained by the hand of the user.

SUMMARY OF INVENTION

It is a feature of the present invention to provide a hand-size abrasive paper sheet holder which substantially overcomes the above-mentioned disadvantages of the prior art and which is easy to use and which incorporates an adjustable pressure applying element to securely attach the abrasive paper to the holder and which is also used to detach the paper sheet from the holder.

Another feature of the present invention is to provide an abrasive paper sheet holder which is easy to use and which is inexpensive and wherein special tools are not required to secure an abrasive paper sheet thereto.

According to the above features, from a broad aspect, the present invention provides an abrasive paper sheet holder which comprises a base having clamping means in an pair of opposed side edges thereof. A handle member is detachably secured over a rear surface of the base. The handle member has opposed flexible wedge means for clamping opposed edge portions of an abrasive paper sheet positioned over a front working surface of the base with the edge portions of the sheet extending over the clamping means. Means is also provided to apply wedging pressure on the flexible wedge means to immovably clamp the opposed portions of the abrasive paper sheet between the clamping means and the flexible wedge means.

According to a still further broad aspect of the present invention, a finger actuable wedge element is slidingly secured in the handle member to apply wedging pressure between the opposed flexible wedge means and the clamping means to immovably retain the abrasive sheet over the working surface of the holder and to also detach the abrasive sheet from the holder.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
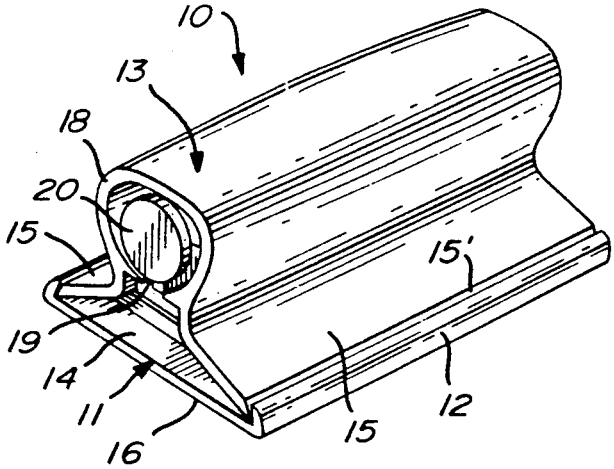
FIG. 1 is a perspective view of the abrasive paper sheet holder of the present invention.
Figure 3:
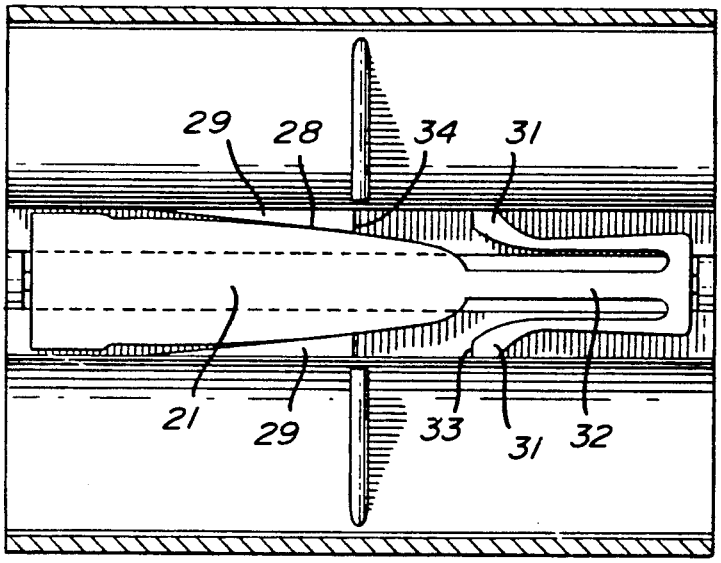
FIGS. 3, 4 and 5 are bottom views of the paper sheet holder as seen through cross-section lines III—III of FIG. 2.
Figure 2:
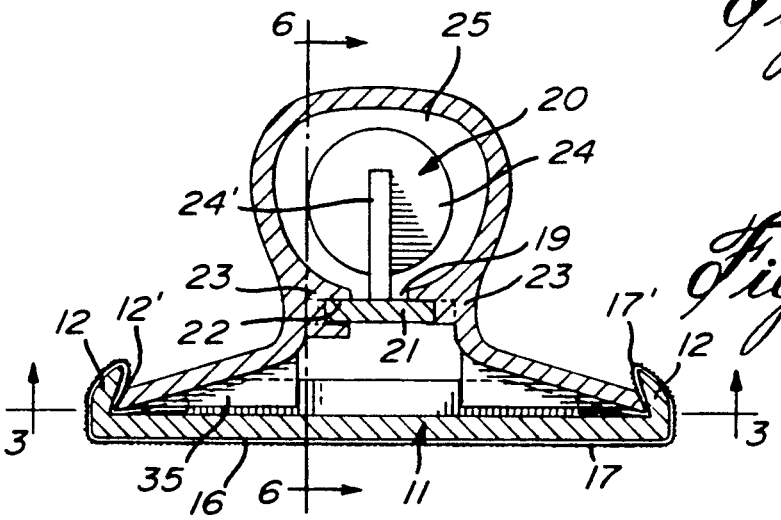
FIG. 2 is a section view through section lines II—II of FIG. 4.

Referring now to the drawings, and more particularly to FIG. 1, there is shown generally at 10, the abrasive paper sheet holder of the present invention. As hereinshown, the holder 10 has a base 11 provided with opposed clamping means in the form of clamping shoulders 12 disposed along a pair of opposed side edges thereof. A handle member 13 is detachably secured over a rear surface 14 of the base 11. The handle member 13 has opposed flexible wedge means in the form of flexible flange walls 15 for clamping opposed edge portions of an abrasive paper sheet positioned over the front working surface 16 of the base 11, as shown in FIG. 2. As can be seen in FIG. 2, the abrasive paper 17 is disposed over the flat working face 16 and over the clamping shoulders 12.

The flexible flange walls 15 are also formed integral with a handle formed as an inverted U-shaped wall section 18 disposed between the flexible flange walls. The flange walls, as better shown in FIG. 2, extend outwardly and are sloped upwards of the slot opening 19 formed by the U-shaped wall section. This slot opening 19 permits the opposed flexible flange walls 15 to be retracted by compressing the U-shaped wall section with the hand.

A finger actuable wedge element 20 constitutes a means to apply wedging pressure between the elongated end edges 15' of the flexible flange walls 15 and its respective adjacent clamping shoulders 12. It is also conceivable that the inverted U-shaped wall section 18 and the flexible flange walls be dimensioned whereby the handle member is connected between the clamping shoulders 12 by squeezing the handle member to retract the flexible flange walls. With the flexible flange walls retracted inwardly due to the slot opening 19, they can then be positioned between the clamping shoulders and the compression pressure then released. The spring action of the U-shaped wall section 18 would apply wedging pressure between the opposed elongated end edges 15' of the flexible flange walls 15 and sufficient to clamp the edge portions 17' of the abrasive paper sheet 17. However, the wedge element 20 is preferred in that it applies a positive wedging action and prevents the flexible flange walls 15 from flexing inwardly after the abrasive paper is clamped down.

As shown in FIG. 2, the finger actuable wedge element 20 is comprised of a flat slide member 21 which is guidingly supported in the opening 19 in a side slot 22 formed in one of the side wall portions 23 of the U-shaped member adjacent the opening 19. A pusher member 24 is secured to the slide member 21 by a rib 24 and extends in a hollow space 25 in the inverted U-shaped wall section or handle portion and permits finger engagement thereto to push the slide member in a wedge engaging direction, as shown by arrow 26 in FIG. 4, and a counter-wedge disengaging direction, as shown by arrow 27 in FIG. 5.

Figure 4:
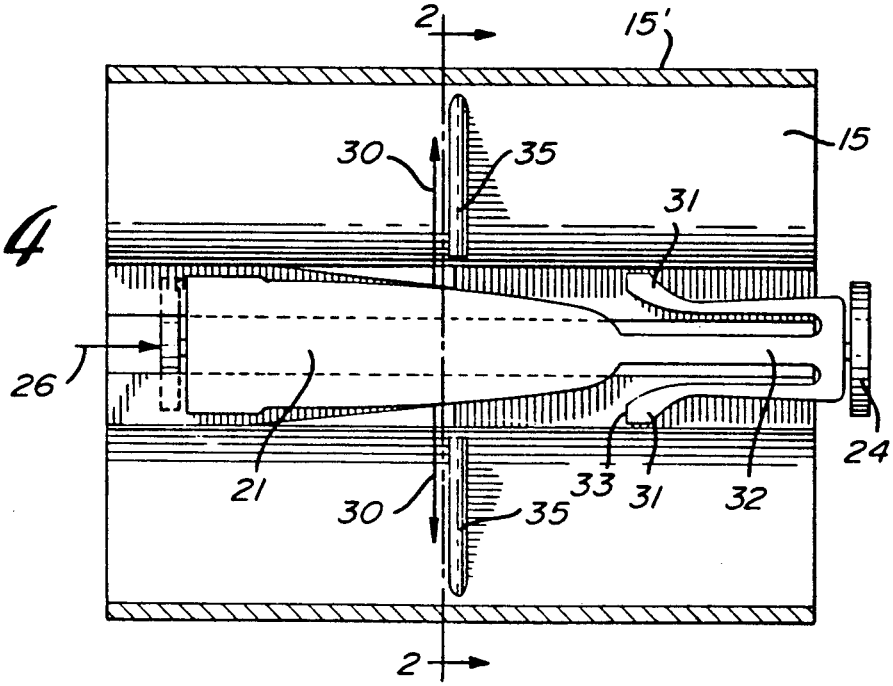

Referring now additionally to FIGS. 3 to 6, it can be seen that the slide member 21 is provided with sloped opposed side edges 28 to form wedge edges. A wedge element 29 is also secured to each of the side wall portions 25 and aligned with the plane of the slide member 21 whereby to engage with the wedge edge 29 when the slide member 21 is displaced in the direction of arrow 26, as shown in FIG. 4.

When the slide member is so displaced, outward pressure is applied in the direction of arrows 30 to displace the end edges 15' of the flexible flange walls 15 outwardly to provide wedging pressure against the clamping shoulders 12.

The wedge element 29 is also provided with a flexible finger member 31 disposed forwardly of the wedge edges 28 and retained by a narrow neck portion 32 formed integral with the slide member 21. The flexible fingers are provided with a free arresting end 33 for arresting abutment against an end wall 34 of a respective wedge element 29 when the pusher member is displaced in the disengaging direction, as indicated by arrow 27 in FIG. 5. Accordingly, the wedge element 20 is slidingly retained within the handle member 13.

Figure 6:
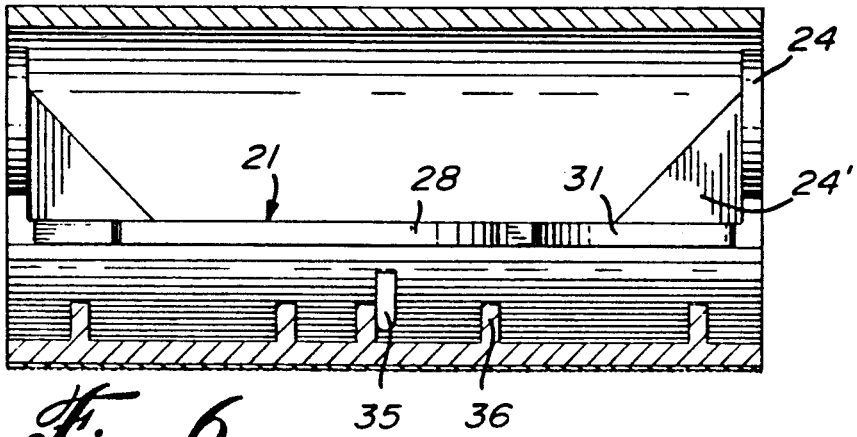
FIG. 6 is a cross-section view along cross-section lines VI—VI of FIG. 2.

As shown in FIG. 2, the base 11 is formed by a flat wall 16 but this wall could also be curved or angulated such as for sanding corners. The clamping shoulders 12, as hereinshown, extend rearwardly of the flat base 11 and have an inwardly inclined inner edge wall 12'. The elongated end edge 15' of the flexible flange walls 15 have a tapered wedge edge, as better seen in FIG. 2, to engage behind the inner edge wall 12' of the shoulders 12 to immovably wedge the abrasive end edge portion 17' of the abrasive sheet therein. As is also shown in FIG. 2, the flexible flange walls 15 are provided with reinforcing ribs 35. Further reinforcing ribs 36 are also provided transversely of the base bottom wall, as is shown in FIG. 6. The abrasive paper sheet holder as hereinshown is also molded from plastic material but can also be manufactured from metal parts.

Figure 5:
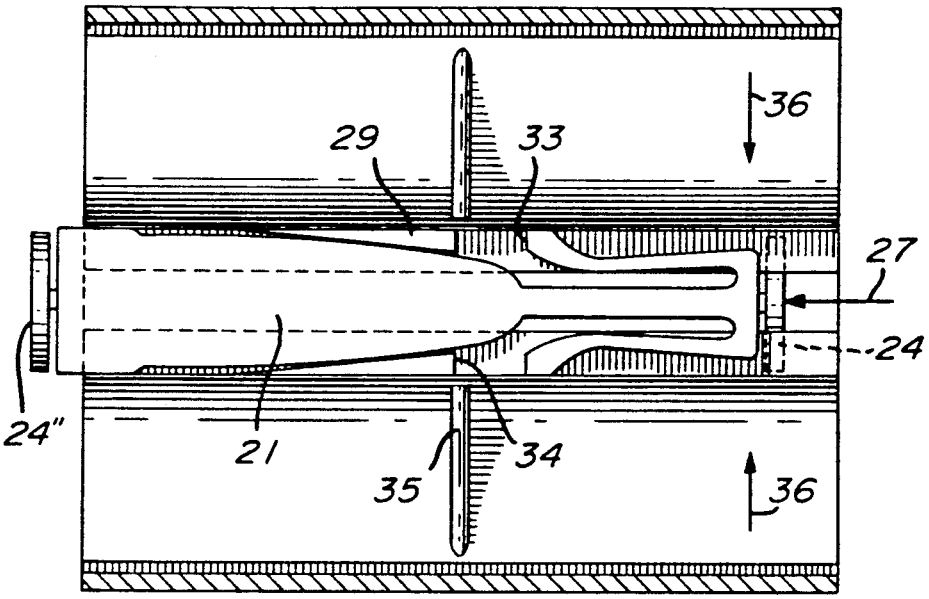

Briefly summarizing the operation of the abrasive paper sheet holder of the present invention, it is firstly necessary to remove the handle member 13 from the base 11. This is done by pushing on the pusher member 24' in the direction of arrow 27, as shown in FIG. 5, and until the arresting ends 33 of the flexible fingers 31 abut against the end walls 34 of the wedge elements 29. This removes the clamping pressure between the end edge 15' of the flexible flange walls 15 and the clamping shoulders 12. By compressing the U-shaped wall section 18 or the handle member 13, the flexible flange walls 15 are retracted inwardly in the direction of arrows 36, as shown in FIG. 5. This permits the handle member to be disconnected from the base member. A sheet of abrasive paper, such as paper 17, which is cut to the proper size to cover the base working surface 16, is fitted over the working surface 16 with the end edge portions thereof wrapped around the clamping shoulders 12, as shown in FIG. 2. The handle member 13 is again compressed retracting the flexible flange walls 15 and positioned between the clamping shoulders where the compression is then released and the pusher member 24'' is then pushed inwardly to cause the wedge edge 28 of the slide member to engage with the wedge elements 29 and apply outward pressure to clamp the abrasive paper in the joint area formed between the end edges 15' of the flexible flange walls 15 and the inner clamping face 12' of the clamping shoulders 12. The abrasive paper is thus rigidly secured to the holder 10.

It is within the ambit of the present invention to cover any obvious modifications of the preferred embodiment described herein provided such modifications fall within the scope of the appended claims.

I claim:

1. An abrasive paper sheet holder comprising a base having clamping means in a pair of opposed side edges thereof, a handle member detachably secured over a rear surface of said base, said handle member having opposed flexible flange walls on each side thereof for clamping opposed edge portions of an abrasive paper sheet positioned over a front working surface of said base with said edge portions extending over said clamping means, a flexible connection between said flange walls, said flange walls having an outer wedging edge to engage said clamping means and apply pressure thereagainst, said flange walls being compressed through said flexible connection to apply outward pressure against said clamping means when engaged therewith, a finger actuable wedge element displaceably retained in said handle member to apply wedging pressure on said flexible wedge means to immmovably clamp said opposed edge position of said abrasive paper sheet between said clamping means and said flexible wedge means said wedge element being a slide member guidingly supported for sliding displacement in a slot opening in said flexible connection, said slide member having opposed side edges, one of which is sloped to form a wedge edge to frictionally engage a wedge element of side flexible connection to cause outward displacement of said flange walls when said sloped side edge is pushed against said wedge element, said wedge element having arresting means to retain same in sliding engagement with said handle member.

2. An abrasive paper sheet holder as claimed in claim 1 wherein said flexible wedge mean is comprised by opposed flexible flange walls formed on each side of said handle member, said flange walls being interconnected by a flexible connection to permit an outer wedging edge of each flange wall to be retracted from clamping engagement with said clamping means.

3. An abrasive paper sheet holder as claimed in claim 2 wherein said flexible connection is an integrally formed inverted U-shaped wall section disposed between said opposed flexible flange walls, said flange walls extending outwardly and sloped upwards of said slot opening which is formed by said U-shaped wall section, said slot opening permitting said opposed flexible flange walls to be retracted by permitting said U-shaped wall section to assume its original shape.

4. An abrasive paper sheet holder as claimed in claim 3 wherein said clamping means is constituted by a rearwardly extending shoulder formed along each said opposed side edges of said pair of said edges of said base.

5. An abrasive paper sheet holder as claimed in claim 4 wherein each shoulder has an inwardly inclined inner edge wall, said outer wedging edge of said opposed flexible flange walls having a tapered wedge edge to engage behind said inner edge wall of said shoulders.

6. An abrasive paper sheet holder as claimed in claim 3 said slide member is guidingly supported in a side slot formed in one of said side wall portions of said slot opening, and a pusher member secured to said slide member and extending in a hollow space of said inverted U-shaped wall section for finger engagement to push said slide member in a wedge engaging direction and a counter wedge disengaging direction.

7. An abrasive paper sheet holder as claimed in claim 6 wherein opposed side edges of said wedge member are sloped to form opposed wedge edges, there being one of said wedge elements on opposed side wall portions of said slot opening, said arresting means being a flexible finger member disposed forwardly of each said opposed wedge edges and retained by a narrow neck portion of said slide member and flexing towards said neck portion, said finger members having a free arresting end for arresting abutment against an end wall of a respective one of each said wedge elements when said pusher member is displaced in said disengaging direction.

* * * * *